US009784036B2

(12) United States Patent
Samuel

(10) Patent No.: US 9,784,036 B2
(45) Date of Patent: Oct. 10, 2017

(54) ROTARY STEERABLE DRILLING SYSTEM AND METHOD

(75) Inventor: Robello Samuel, Houston, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 626 days.

(21) Appl. No.: 14/233,350

(22) PCT Filed: Jul. 11, 2011

(86) PCT No.: PCT/US2011/043535

§ 371 (c)(1),
(2), (4) Date: Jan. 16, 2014

(87) PCT Pub. No.: WO2013/009285

PCT Pub. Date: Jan. 17, 2013

(65) Prior Publication Data

US 2014/0190750 A1 Jul. 10, 2014

(51) Int. Cl.

| | |
|---|---|
| ***E21B 7/06*** | (2006.01) |
| ***E21B 41/00*** | (2006.01) |
| ***E21B 44/00*** | (2006.01) |

(52) U.S. Cl.

CPC ..... *E21B 7/062* (2013.01); *E21B 41/0092* (2013.01); *E21B 44/00* (2013.01)

(58) Field of Classification Search

CPC . E21B 7/062; E21B 7/068; E21B 7/28; E21B 7/04; E21B 44/00; E21B 10/26; E21B 17/10

See application file for complete search history.

(56) References Cited

U.S. PATENT DOCUMENTS

| | | | | |
|---|---|---|---|---|
| 2,745,635 | A | 5/1956 | Zublin | |
| 3,049,185 | A * | 8/1962 | Herbold | E21B 7/206 166/233 |
| 4,303,135 | A | 12/1981 | Benoit | |
| 4,962,818 | A | 10/1990 | DeLucia | |
| 5,094,304 | A | 3/1992 | Briggs | |
| 5,368,109 | A | 11/1994 | Pittard, Jr. et al. | |
| 5,547,031 | A | 8/1996 | Warren et al. | |
| 5,620,056 | A | 4/1997 | Eppink | |

(Continued)

FOREIGN PATENT DOCUMENTS

WO WO 98/15710 A1 4/1998

OTHER PUBLICATIONS

Extended European Search Report, dated Dec. 7, 2015, EP11869401.7, 7 pages.

(Continued)

*Primary Examiner* — Robert E Fuller
*Assistant Examiner* — David Carroll

(57) ABSTRACT

A drilling system may include an outer sleeve, and a rotary steerable module including a shaft extending within the outer sleeve. The rotary steerable module may further include bearings disposed within the outer sleeve and through which the shaft extends, and cams positioned along the shaft between the bearings. Each cam may include an eccentric ring through which the shaft extends. Each extension of the shaft through one of the eccentric rings defines a bend in the shaft within the outer sleeve, the bend having a bend angle. A method of use and a drilling control apparatus are also provided.

14 Claims, 9 Drawing Sheets

(56) References Cited

U.S. PATENT DOCUMENTS

| | | | | |
|---|---|---|---|---|
| 6,234,259 | B1 * | 5/2001 | Kuckes | E21B 7/062 175/61 |
| 6,659,201 | B2 | 12/2003 | Head et al. | |
| 7,287,604 | B2 | 10/2007 | Aronstam et al. | |
| 2002/0043372 | A1 * | 4/2002 | Cargill | E21B 7/062 166/324 |
| 2005/0236187 | A1 * | 10/2005 | Chen | E21B 7/067 175/61 |
| 2010/0065333 | A1 | 3/2010 | Kiyosawa | |

OTHER PUBLICATIONS

PCT International Search Report, dated Dec. 8, 2011, 13 pages PCT/US2011/043535, United States Patent and Trademark Office.
European Office Action, Application No. 11869401.7-1605, PCT/US2011043535, issued by the European Patent Office, dated Feb. 18, 2014, 3 pages.

* cited by examiner

ROTARY STEERABLE DRILLING SYSTEM AND METHOD

BACKGROUND

This disclosure generally relates to drilling systems and more particularly, to rotary steerable drilling systems for oil and gas exploration and production operations.

A rotary steerable drilling system allows a drill string to rotate continuously while steering the drill string to a desired target location in a subterranean formation. A rotary steerable drilling system is limited by its maximum dogleg severity, that is, the maximum deflection rate of the drill string (in, for example, angle per linear length) that can be achieved during drilling.

BRIEF DESCRIPTION OF THE DRAWINGS

A more complete understanding of this disclosure and advantages thereof may be acquired by referring to the following description taken in conjunction with the accompanying figures, wherein.

Figure 1A:
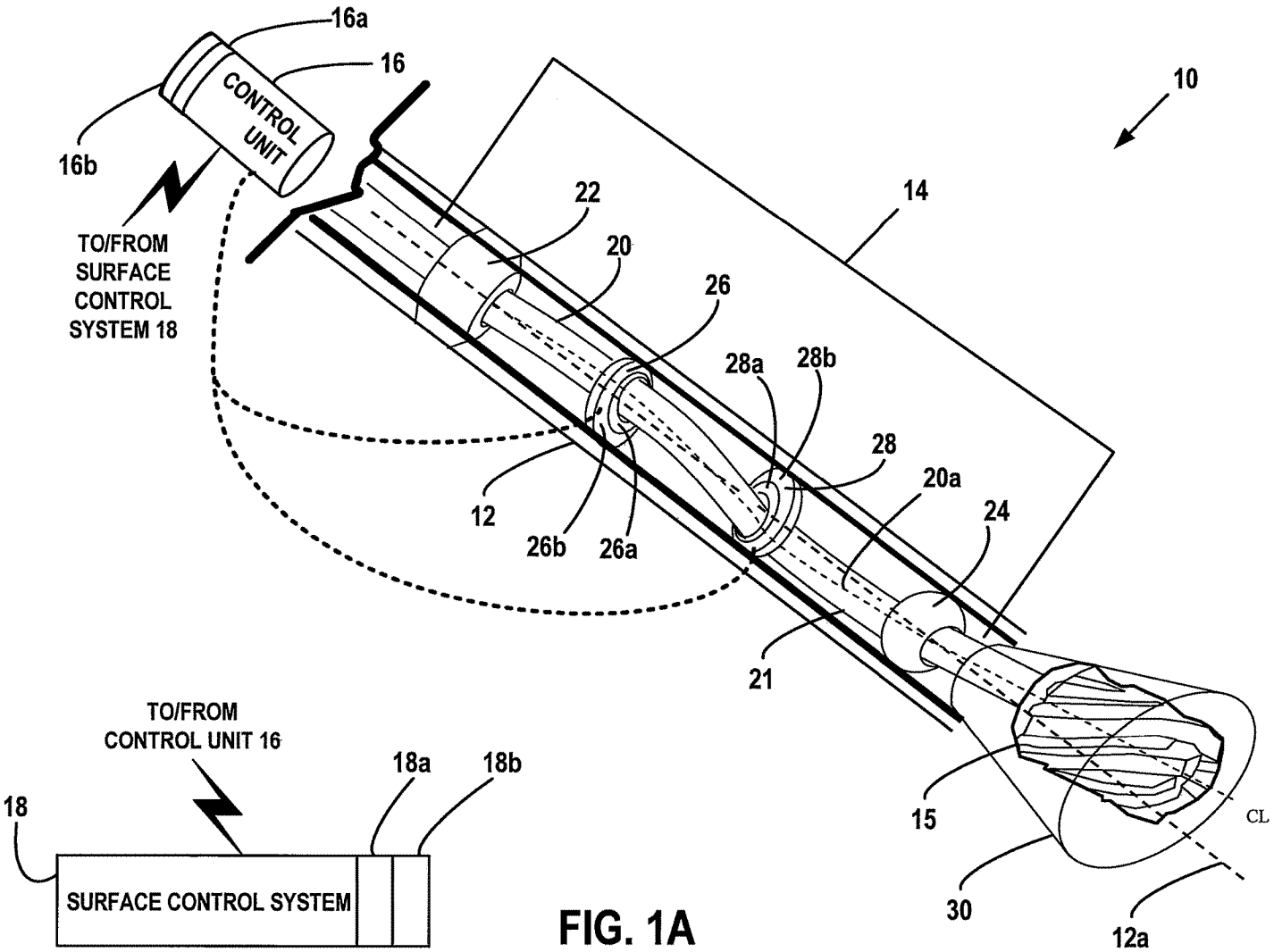
FIG. 1A is a diagrammatic view of a drilling system according to an exemplary embodiment, the drilling system including a rotary steerable module placed in a reverse double bend configuration, according to an exemplary embodiment.

While this disclosure is susceptible to various modifications and alternative forms, specific exemplary embodiments thereof have been shown by way of example in the drawings and are herein described in detail. It should be understood, however, that the description herein of specific embodiments is not intended to limit the disclosure to the particular forms disclosed, but on the contrary, the intention is to cover all modifications, equivalents, and alternatives falling within the spirit and scope of the disclosure as defined by the appended claims.

DETAILED DESCRIPTION

This disclosure generally relates to drilling systems and more particularly, to rotary steerable drilling systems for oil and gas exploration and production operations.

Rotary steerable drilling systems are provided herein that, among other functions, can be used to achieve greater maximum dogleg severities, that is, maximum drill string shaft deflection rates in, for example, angle per linear length.

To facilitate a better understanding of this disclosure, the following examples of certain embodiments are given. In no way should the following examples be read to limit, or define, the scope of the disclosure.

For ease of reference, the terms "upper," "lower," "upward," and "downward" are used herein to refer to the spatial relationship of certain components. The terms "upper" and "upward" refer to components towards the surface (distal to the drill bit or proximal to the surface), whereas the terms "lower" and "downward" refer to components towards the drill bit (proximal to the drill bit or distal to the surface), regardless of the actual orientation or deviation of the wellbore or wellbores being drilled.

In one exemplary embodiment, as illustrated in FIG. 1A, a drilling system is generally referred to by the reference numeral 10 and includes an outer housing or sleeve 12 having a center axis 12*a*. A rotary steerable module 14 is disposed within the outer sleeve 12. A drill bit 15 is positioned proximate to the lowermost or distal end of the outer sleeve 12. A control unit 16 is provided to control the rotary steerable module 14, under conditions to be described below. In one exemplary embodiment, the control unit 16 is connected to, and/or disposed within, the outer sleeve 12. In one exemplary embodiment, the control unit 16 includes one or more measurement-while-drilling (MWD) systems, one or more logging-while-drilling (LWD) systems, and/or any combination thereof. In one exemplary embodiment, the control unit 16 includes one or more processors 16*a*, a memory or computer readable medium 16*b* operably coupled to the one or more processors 16*a*, and a plurality of instructions stored in the computer readable medium 16*b* and executable by the one or more processors 16*a*. A surface control unit or system 18 is in two-way communication with the control unit 16. In one exemplary embodiment, the surface control system 18 includes one or more processors 18*a*, a memory or computer readable medium 18*b* operably coupled to the one or more processors 18*a*, and a plurality of instructions stored in the computer readable medium 18*b* and executable by the one or more processors 18*a*.

The rotary steerable module 14 includes a flexible lever arm or shaft 20 having a center axis 20*a* and extending within the outer sleeve 12. As shown in FIG. 1A, in one exemplary embodiment, the drill bit 15 is attached to the lowermost or distal end of the shaft 20, and is positioned outside of the outer sleeve 12. In several exemplary embodiments, the shaft 20 is, includes, or is part of, a drill string 21, the lowermost or distal end of which is connected to the drill bit 15. A cantilever bearing 22 is disposed within, and connected to, the outer sleeve 12. A focal bearing 24 is disposed within, and connected to, the outer sleeve 12. The shaft 20 extends through each of the cantilever bearing 22 and the focal bearing 24.

An upper cam 26 is disposed within the outer sleeve 12 and between the cantilever bearing 22 and the focal bearing 24. The upper cam 26 includes an inner eccentric ring 26*a* through which the shaft 20 extends, and an outer eccentric ring 26*b* extending about the inner eccentric ring 26*a* and connected to the outer sleeve 12. The inner eccentric ring 26*a* is engaged with the shaft 20 and may rotate therewith, relative to each of the outer eccentric ring 26*b* and the outer sleeve 12, under conditions to be described below. The control unit 16 is operably coupled to the upper cam 26 and controls the rotation of the upper cam 26 about the center axis 12*a* to any toolface setting and at least the inner eccentric ring 26*a* to varying degrees of offset from the center. More particularly, the control unit 16 causes at least one of the eccentric rings 26*a* and 26*b* to rotate about the center axis 12*a* to a predetermined angular position, relative to the outer sleeve 12, as shown in FIG. 1A. As a result of the extension of the shaft 20 through the inner eccentric ring 26*a* and the rotation of at least one of the eccentric rings 26*a* and 26*b* about the center axis 12*a* to the predetermined angular position, the shaft 20 bends at the upper cam 26. In one exemplary embodiment, both of the eccentric rings 26*a* and 26*b* rotate about the center axis 12*a*.

A lower cam 28 is disposed within the outer sleeve 12 and between the upper cam 26 and the focal bearing 24. The lower cam 28 includes an inner eccentric ring 28*a* through which the shaft 20 extends, and an outer eccentric ring 28*b* extending about the inner eccentric ring 28*a* and connected to the outer sleeve 12. The inner eccentric ring 28*a* is engaged with the shaft 20 and may rotate therewith, relative to each of the outer eccentric ring 28*b* and the outer sleeve 12, under conditions to be described below. The control unit 16 is operably coupled to the lower cam 28 and controls the rotation of the lower cam 28 about the center axis 12*a* to any toolface setting and at least the inner eccentric ring 28*a* to varying degrees of offset from the center. More particularly, the control unit 16 can cause at least one of the eccentric rings 28*a* and 28*b* to rotate about the center axis 12*a* to a predetermined angular position, relative to the outer sleeve 12, as shown in FIG. 1A. As a result of the extension of the shaft 20 through the inner eccentric ring 28*a* and the rotation of at least one of the eccentric rings 28*a* and 28*b* about the center axis 12*a* to the predetermined angular position, the shaft 20 bends at the lower cam 28. In one exemplary embodiment, both of the eccentric rings 28*a* and 28*b* rotate about the center axis 12*a*.

In several exemplary embodiments, the upper cam 26 and/or the lower cam 28 may be part of, include, or use, one or more of the annular rotational members and/or harmonic drive mechanisms described in one or more of U.S. Pat. No. 5,307,885 to Kuwana et al., U.S. Pat. No. 5,353,884 to Misawa et al., and U.S. Pat. No. 5,875,859 to Ikeda et al., and/or one or more components of such annular rotational members and/or harmonic drive mechanisms. In one exemplary embodiment, the upper cam 26 or the lower cam 28 is, or includes, a drilling direction control device disclosed in U.S. Pat. No. 5,353,884 to Misawa et al., and/or includes one or more components of the drilling direction control device such as, for example, one or more harmonic drive mechanisms, double eccentric mechanisms, and annular members. In one exemplary embodiment, the upper cam 26 or the lower cam 28 is, or includes, a drilling-direction control device disclosed in U.S. Pat. No. 5,307,885 to Kuwana et al., and/or includes one or more components of the drilling-direction control device such as, for example, one or more harmonic drive mechanisms and rotational discs. In one exemplary embodiment, the upper cam 26 or the lower cam 28 is, or includes, a device for controlling the drilling direction of drills as disclosed in U.S. Pat. No. 5,875,859 to Ikeda et al., and/or includes one or more components of the device such as, for example, one or more double eccentric mechanisms and controlling systems.

In one exemplary embodiment, the drilling system 10 is a double bend point-the-bit rotary steerable system, which allows the drill bit 15 to tilt in any direction as indicated by the range of movement 30, under conditions to be described below (e.g., if the distal end portion of the drill string 21 extends horizontally, the drill bit 15 is allowed to tilt up, right, down or left).

In operation, in one exemplary embodiment, the drilling system 10 drills or penetrates directionally into a subterranean ground formation for the purpose of recovering hydrocarbon fluids from the formation. As the drilling system 10 penetrates into the formation directionally, a wellbore is formed (the wellbore is not shown in FIG. 1A). During the directional drilling, the rotary steerable module 14 enables the drill string 21, and thus the flexible shaft 20 and the drill bit 15, to rotate continuously and, at the same time, steer the drill string 21 to the desired target location in the formation. The ability to steer on the fly or continuously during drilling is one important aspect of the rotary steerable module 14. By rotating the drill string 21, axial drag is reduced, thereby increasing the amount of weight on bit (WOB) available at the drill bit 15. During the rotation of the drill string 21, the shaft 20 rotates about the center axis 20*a*, relative to the outer sleeve 12, the cantilever bearing 22, the focal bearing 24, the outer eccentric ring 26*b*, and the outer eccentric ring 28*b*, while maintaining the respective bends in the shaft 20 at the cams 26 and 28. During the rotation of the drill string 21, the inner eccentric ring 26*a* may rotate along with the shaft 20, relative to the outer eccentric ring 26*b* and the outer sleeve 12. Likewise, the inner eccentric ring 28*a* may rotate along with the shaft 20, relative to the outer eccentric ring 28*b* and the outer sleeve 12. During operation, the drilling system 10 operates as a double bend point-the-bit rotary steerable system, allowing the drill bit 15 to tilt in any direction as indicated by the range of movement 30, to the desired direction in order to reach the desired target location in the formation. The tilt of the drill bit 15 is changed using the bending of the shaft 20 at the cams 26 and 28. In several exemplary embodiments, during the directional drilling, the drill bit 15 is rotated by one or more surface rotary drives, steerable motors, mud motors, positive displacement motors (PDMs), electrically-driven motors, and/or any combination thereof.

During operation, in one exemplary embodiment, a control unit 16 positioned in the wellbore communicates with the surface control system 18, sending directional survey information to the surface control system 18 using a telemetry system. In one embodiment, the telemetry system utilizes mud-pulse telemetry. In any event, the control unit 16 may transmit to the surface control system 18 information about the direction, inclination and orientation of the drilling system 10. In one exemplary embodiment, the surface control system 18 controls the rotary steerable module 14 via the control unit 16. During operation, in one exemplary embodiment, the control unit 16 controls the rotary steerable module 14, controlling the rotation of the upper cam 26 and the lower cam 28 to any toolface setting, and controlling the offset of each of the inner eccentric rings 26*a* and 28*a* from the center. In one exemplary embodiment, one or both of the control unit 16 and the surface control system 18 are part of a downlink system that allows for automatic steering along a fixed or preprogrammed trajectory towards the desired target location in the formation. In one exemplary embodiment, to control the rotary steerable module 14 using the surface control system 18 and/or the control unit 16, the one or more processors 16*a* and/or the one or more processors 18*a* execute the plurality of instructions stored in the computer readable medium 16*b* and/or the plurality of instructions stored in the computer readable medium 18*b*.

During operation, the shaft 20 can pivot at the upper cam 26, as well as at the lower cam 28. Due to the cams 26 and 28, and the accompanying pivot actions of the shaft 20 at the cams 26 and 28, wide ranges of dogleg severity (or deflection rate in, for example, angle per linear length) can be achieved. As a result, as shown in FIG. 1A, the drill bit 15 has a range of movement 30. As further shown in FIG. 1A, the center axis 20*a* of the shaft 20 is angularly offset from the center axis 12*a* of the outer sleeve 12 throughout the great majority of the range of movement 30 of the drill bit 15 except when, for example, the center axes 20*a* and 12*a* are aligned. Moreover, the shaft 20 can bend negatively, that is, the shaft can pivot in respective opposite directions at the cams 26 and 28, resulting in a reverse double bend configuration as shown in FIG. 1A. To achieve an explicit deflection rate, the two bend angles at the cams 26 and 28, respectively, may be in the same plane, and can bend to the accordant or reverse direction (the reverse direction is shown in FIG. 1A). As noted above, the control unit 16 controls the rotation of the upper cam 26 and the lower cam 28 to any toolface setting, and controls the offset of each of the inner eccentric rings 26*a* and 28*a* from the center. Moreover, forces are applied internally within the outer sleeve 12 using the shaft 20 and the cams 26 and 28. As a result, the bend angle(s) of the shaft 20 can be adjusted on the fly, thereby imparting a side force at the drill bit 15 as desired for building or dropping.

Figure 1B:
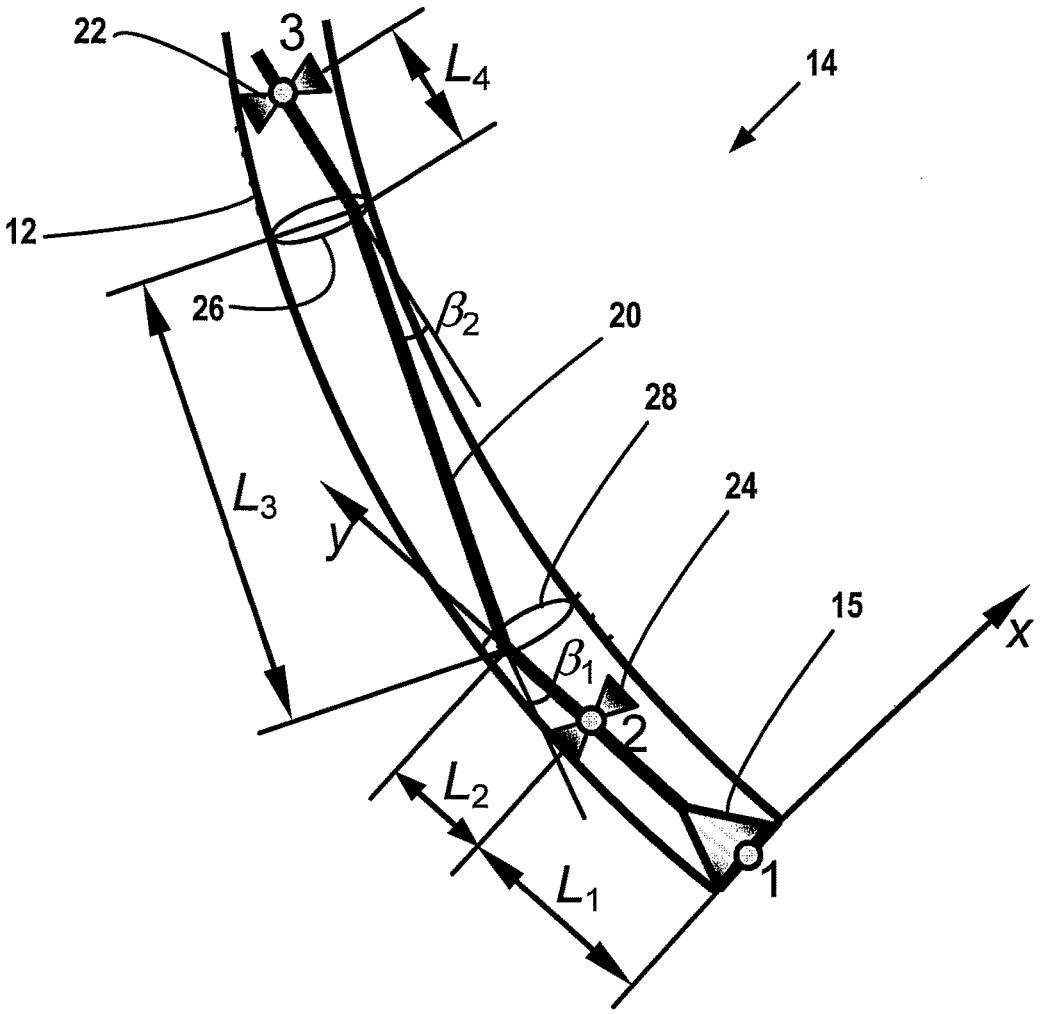
FIG. 1B is an equivalent geometric diagram of the rotary steerable module of FIG. 1A, according to an exemplary embodiment.

During operation, in one exemplary embodiment and referring to FIG. 1B with continuing reference to FIG. 1A, bend angles $\beta_1$ and $\beta_2$ at the cams 28 and 26, respectively, are in the same plane and the rotary steerable module 14 is bent to the reverse direction, that is, placed in the reverse double bend configuration shown in FIG. 1A, so that the operational parameters of the drilling system 10 may be analyzed using the equivalent geometrical diagram shown in FIG. 1B.

More particularly, the drill bit 15 (point 1 in FIG. 1B), the bottom contact at the focal bearing 24 (point 2 in FIG. 1B), and the top contact at the cantilever bearing 22 (point 3 in FIG. 1B) form three control points (the points 1, 2 and 3) to prescribe a circle, and the curvature of the circle is the reciprocal of its radius. For a double bend configuration, an example of which is shown in FIGS. 1A and 1B, except $x_1=0$, $y_1=0$, $x_2=0$, other coordinates of the three points 1, 2 and 3 are set forth in Equation (1) below:

$$\begin{cases} y_2 = L_1 \\ x_3 = L_3\sin\beta_1 + L_4\sin(\beta_1+\beta_2) \\ y_3 = L_1 + L_2 + L_3\cos\beta_1 + L_4\cos(\beta_1+\beta_2) \end{cases} \quad (1)$$

Since the configuration shown in FIGS. 1A and 1B is a reverse double bend configuration, the upper bent angle $\beta_2$ is a negative value as it bends to the reverse direction of the lower bent angle $\beta_1$. Substituting Equation (1) in the general three point equation and using field units of bend angle and deflection rate yields Equation (2) below:

$$\delta = \frac{200}{L_T}(\lambda_1\beta_1 + \lambda_2\beta_2)(°/100\text{ ft}) \quad (2)$$

where:

$$L_S = L_2 + L_3 + L_4,\ L_T = L_1 + L_S,\ \lambda_1 = 1 - \frac{L_2}{L_S},\ \lambda_2 = \frac{L_4}{L_S}$$

Figure 2A:
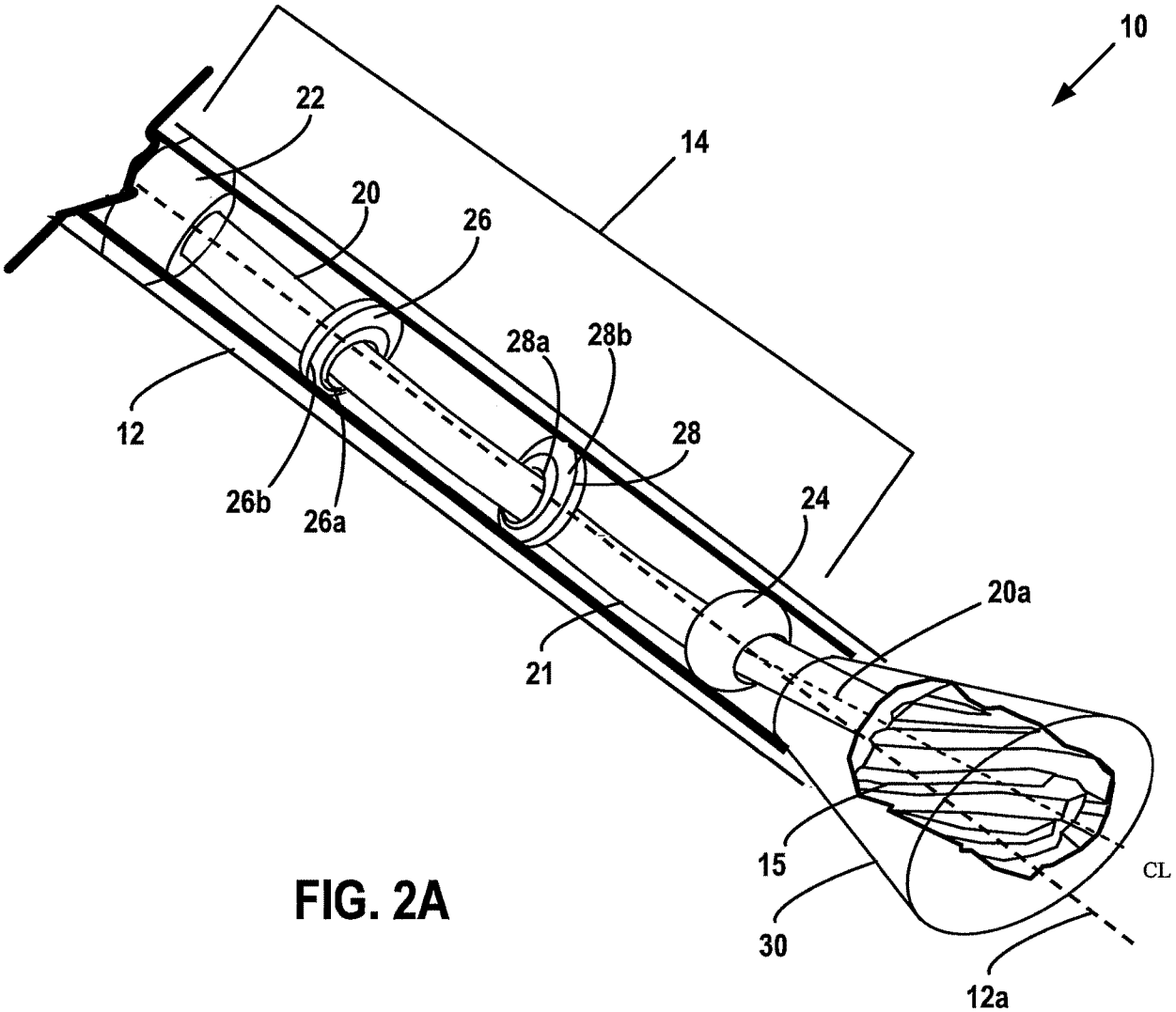
FIG. 2A is a diagrammatic view of the rotary steerable module of FIG. 1A, but depicts the rotary steerable module in an accordant double bend configuration, according to an exemplary embodiment.
Figure 2B:
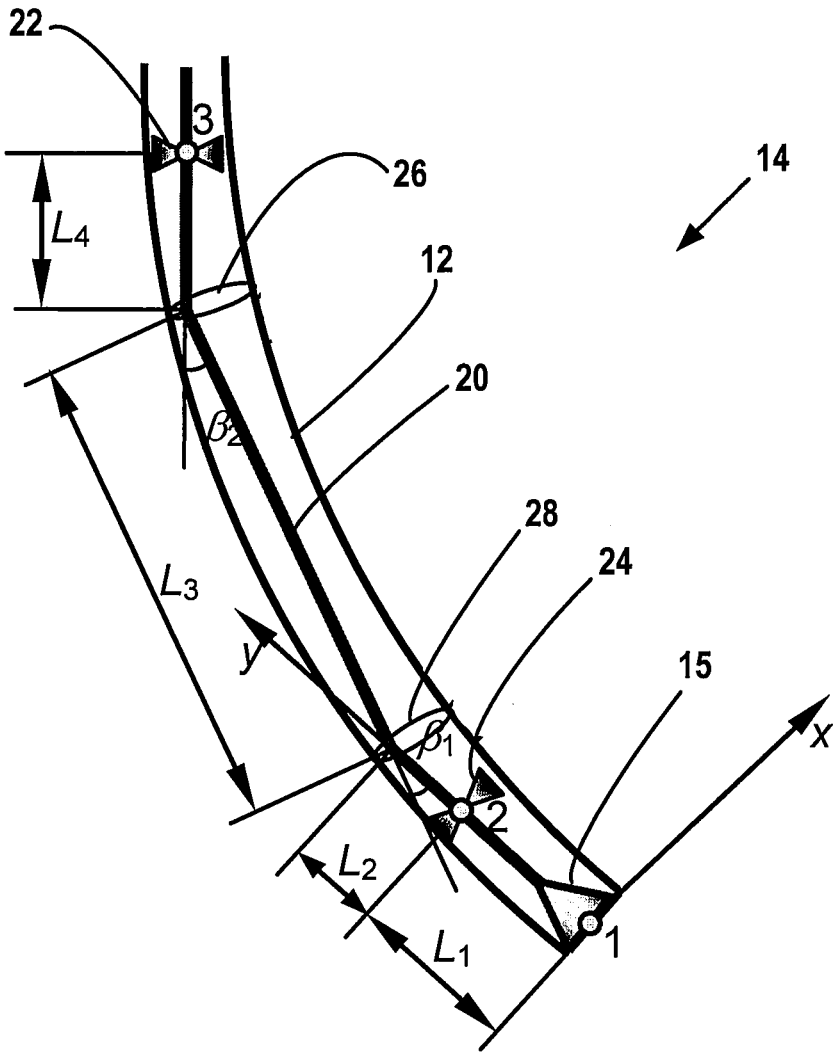
FIG. 2B is an equivalent geometric diagram of the rotary steerable module of FIG. 2A, according to an exemplary embodiment.

$\beta_1$=Lower bent angle, degrees
$\beta_2$=Upper bent angle, degrees
$L_1$=Lower bent angle to bit distance, ft
$L_2$=Upper bent angle to lower bent angle distance, ft
$L_3$=Upper bent-angle to lower bent-angle distance, ft
$L_4$=Top stabilizer to upper bent-angle distance, ft
$\lambda_1$=Influencing factor of lower bent-angle position, dimensionless
$\lambda_2$=Influencing factor of upper bent-angle position, dimensionless In one exemplary embodiment, referring to FIGS. 2A and 2B with continuing reference to FIGS. 1A and 1B, during operation, instead of, or in addition to placing the rotary steerable module 14 in the reverse double bend configuration, the control unit 16 controls the cams 26 and 28 to place the rotary steerable module 14 in an accordant double bend configuration, as shown in FIG. 2A. More particularly, the control unit 16 causes at least one of the eccentric rings 26*a* and 26*b* to rotate about the center axis 12*a* to a predetermined angular position, relative to the outer sleeve 12, as shown in FIG. 2A. And the control unit 16 causes at least one of the eccentric rings 28*a* and 28*b* to rotate about the center axis 12*a* to a predetermined angular position, relative to the outer sleeve 12. As shown in FIG. 2A, the eccentric rings 26*a* and 26*b* have been rotated to an angular position that is different than the angular position to which the eccentric rings 26*a* and 26*b* have been rotated in FIG. 1A.

During operation, in one exemplary embodiment, the bend angles $\beta_1$ and $\beta_2$ at the cams 28 and 26, respectively, are in the same plane and the rotary steerable module 14 is bent to the accordant direction, that is, placed in the accordant double bend configuration shown in FIG. 2A, so that the operational parameters of the drilling system 10 may be analyzed using the equivalent geometrical diagram shown in FIG. 2B. Equations (1) and (2) described above are used in connection with the equivalent geometrical diagram of FIG. 2B in substantially the same manner as Equations (1) and (2) are used in connection with the equivalent geometrical diagram of FIG. 1B, except that the upper bent angle $\beta_2$ is a positive value as it bends to the accordant direction of the lower bent angle $\beta_1$.

In view of the foregoing, it is clear that the capability of the rotary steerable module 14 to be placed in a single composite double bend configuration, such as the reverse double bend configuration shown in FIGS. 1A and 1B or the accordant double bend configuration shown in FIGS. 2A and 2B, provides for a wide range of accordant and reverse bend positions, resulting in multiple bend settings for drilling.

Moreover, as noted above, due to the cams 26 and 28, and the accompanying respective pivot actions of the shaft 20 at the cams 26 and 28, wide ranges of dogleg severity can be achieved. In several exemplary embodiments, using equivalent input parameters, the double bend configuration(s) of the rotary steerable module 14 can achieve a dogleg severity (or deflection rate) that is greater than that of a single bend configuration.

For example, a well needs a dogleg severity (or deflection rate) of 15.75 degrees per 100 ft. The available tool options are set forth below, each of which has a maximum bend of 1.5 degrees. The maximum deflection rate for each option in the accordant direction is determined as set forth below.

Figure 3:
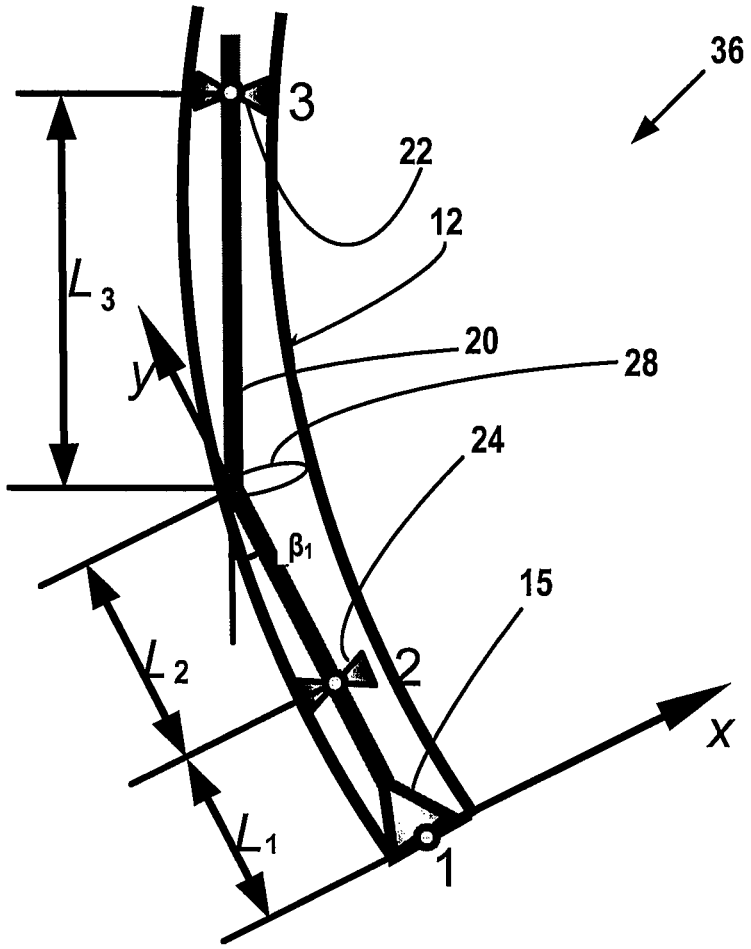
FIG. 3 is an equivalent geometric diagram of a tool option having only a single bend configuration, according to an exemplary embodiment.

Referring to FIG. 3, the equivalent geometric diagram of a tool option having only a single bend configuration is shown, and the tool option is generally referred to by the reference numeral 36. The tool option 36 includes the outer sleeve 12, the drill bit 15, the shaft 20, the cantilever bearing 22, the focal bearing 24, and the lower cam 28. $L_1$ and $L_2$ of the tool option 36 of FIG. 3 represent the same dimensions as $L_1$ and $L_2$ of the rotary steerable module 14 of FIG. 2B. $L_3$ of the tool option 36 of FIG. 3 represents the dimension from the lower cam 28 to the cantilever bearing 22, whereas $L_3$ of the rotary steerable module 14 of FIG. 2B represents the dimension from the lower cam 28 to the upper cam 26. The tool option 36 of FIG. 3 does not include $L_4$, whereas the rotary steerable module 14 of FIG. 2B includes $L_4$, which as noted above represents the dimension from the upper cam 26 to the cantilever bearing 22.

In the example, for the tool option 36 having the single bend configuration as shown in FIG. 3, $L_1$=3 ft, $L_2$=3 ft, and $L_3$=10 ft ($L_4$ is omitted or is considered to be zero). Using Equations (1) and (2) above, and the foregoing input parameters including a maximum bend of 1.5 degrees, the maximum deflection rate is calculated as follows:

$$\delta = \frac{200}{18}(0.7692 \times 1.5) = 14.42(°/100\text{ ft})$$

Therefore, the maximum dogleg severity or deflection rate is 14.42 degrees per 100 ft for the tool option 36 having the single bend configuration as shown in FIG. 3. Therefore, the single bend configuration shown in FIG. 3 cannot achieve the desired dogleg severity of 15 degrees per 100 ft.

In the example, for the rotary steerable module 14 having the accordant double bend configuration of FIG. 2B, $L_1$=3 ft, $L_2$=3 ft, $L_3$=10 ft, and $L_4$=5 ft. Using Equations (1) and (2) above, and the foregoing input parameters including a maximum bend of 1.5 degrees, the maximum deflection rate is calculated as follows:

$$\delta = \frac{200}{21}(0.833 \times 1.5 + 0.277 \times 1.5) = 15.87(°/100\text{ ft})$$

Therefore, the maximum dogleg severity or deflection rate is 15.87 degrees per 100 ft for the rotary steerable module 14 having the accordant double bend configuration as shown in FIG. 2B. Thus, the accordant double bend configuration shown in FIG. 2B can achieve the desired dogleg severity of 15 degrees per 100 ft, whereas the single bend configuration shown in FIG. 3 cannot achieve the desired dogleg severity.

Figure 4:
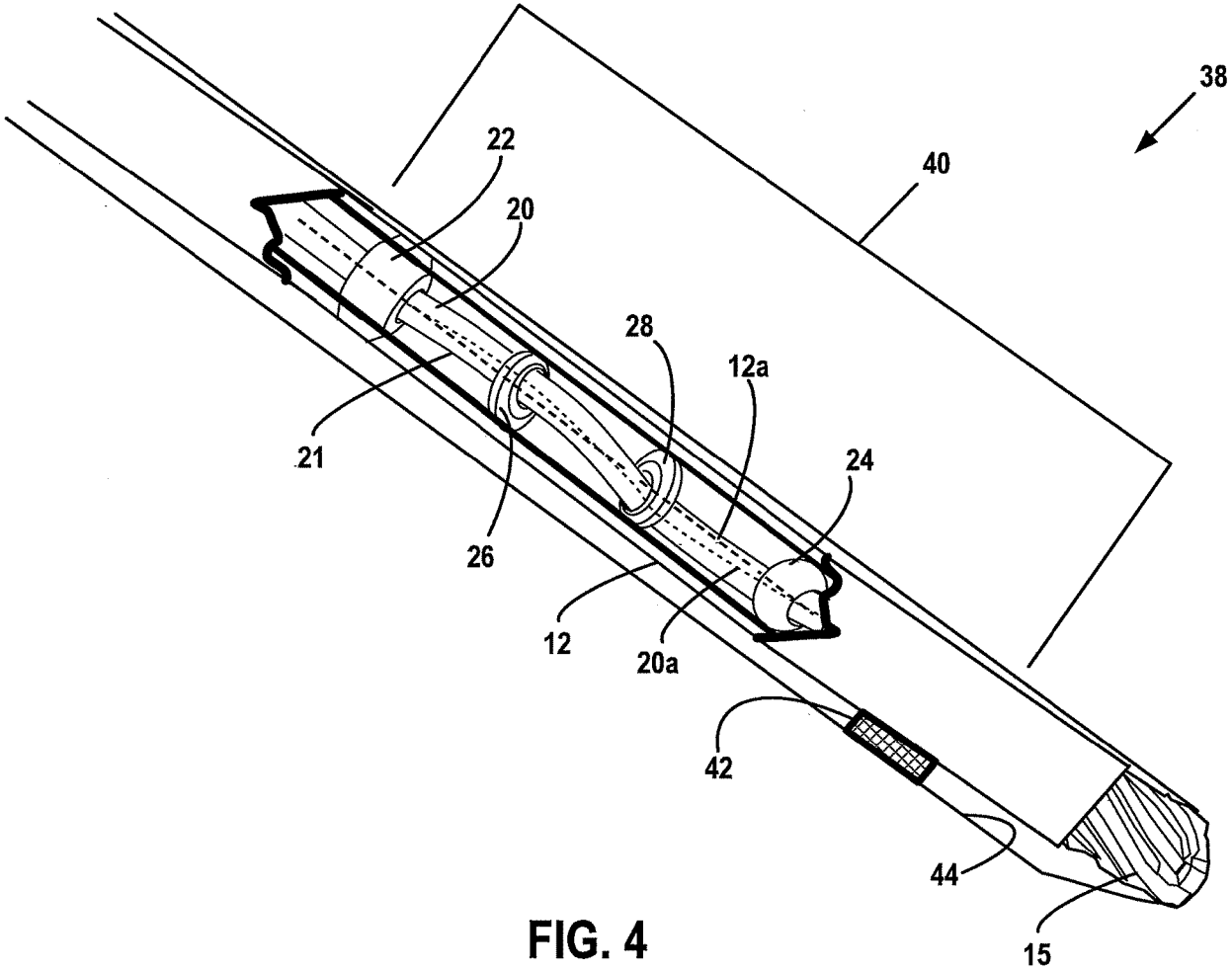
FIG. 4 is a diagrammatic view of a drilling system including a rotary steerable module that includes a pad, according to an exemplary embodiment.

In one exemplary embodiment, as illustrated in FIG. 4, a drilling system is generally referred to by the reference numeral 38 and includes the drill bit 15, the outer sleeve 12, and a rotary steerable module 40, a portion of which is disposed within the outer sleeve 12 and a portion of which is disposed outside of the outer sleeve 12. More particularly, the rotary steerable module 40 includes all of the components of the rotary steerable module 14, which components are given the same reference numerals and are disposed within the outer sleeve 12. The rotary steerable module 40 further includes a pad 42, which is connected to the outer sleeve 12 so that at least a portion of the pad 42 is positioned outside of the outer sleeve 12. The pad 42 is disposed between the focal bearing 24 and the drill bit 15. In one exemplary embodiment, the pad 42 is, includes, or is part of, a side cutting structure. In one exemplary embodiment, the drilling system 38 is a double bend push-the-bit rotary steerable system, which can be placed in either a reverse double bend configuration or an accordant double bend configuration. In several exemplary embodiments, the location of the pad 42, relative to the outer sleeve 12, may be varied. In several exemplary embodiments, the rotary steerable module 40 of the drilling system 38 may include one or more additional pads carried by the outer sleeve 12, each of which may be substantially identical to the pad 42.

In operation, in one exemplary embodiment, the drilling system 38 drills or penetrates into a subterranean ground formation for the purpose of recovering hydrocarbon fluids from the formation. As the drilling system 38 penetrates into the formation, a wellbore 44 is formed. During the drilling, the rotary steerable module 40 enables the drill string 21, and thus the flexible shaft 20 and the drill bit 15, to rotate continuously. The pad 42 interacts with the formation in which the wellbore 44 is being formed, thereby causing a side force to be generated, which side force deviates or pushes the drill bit 15 in a desired direction. In one exemplary embodiment, the pad 42 acts as a pivot for the deflection of the drill bit 15. The placement of the pad 42 and any additional pad(s), relative to the outer sleeve 12, enables the drill bit 15 to be steered in a controlled manner.

In several exemplary embodiments, during operation, the drilling system 38 operates as a double bend push-the-bit rotary steerable system. During operation, the rotary steerable module 40 of the system 38 may be placed in a reverse double bend configuration, as shown in FIG. 4. Alternatively, during operation, instead of a reverse double bend configuration, the rotary steerable module 40 of the system 38 may be placed in an accordant double bend configuration.

Figure 5:
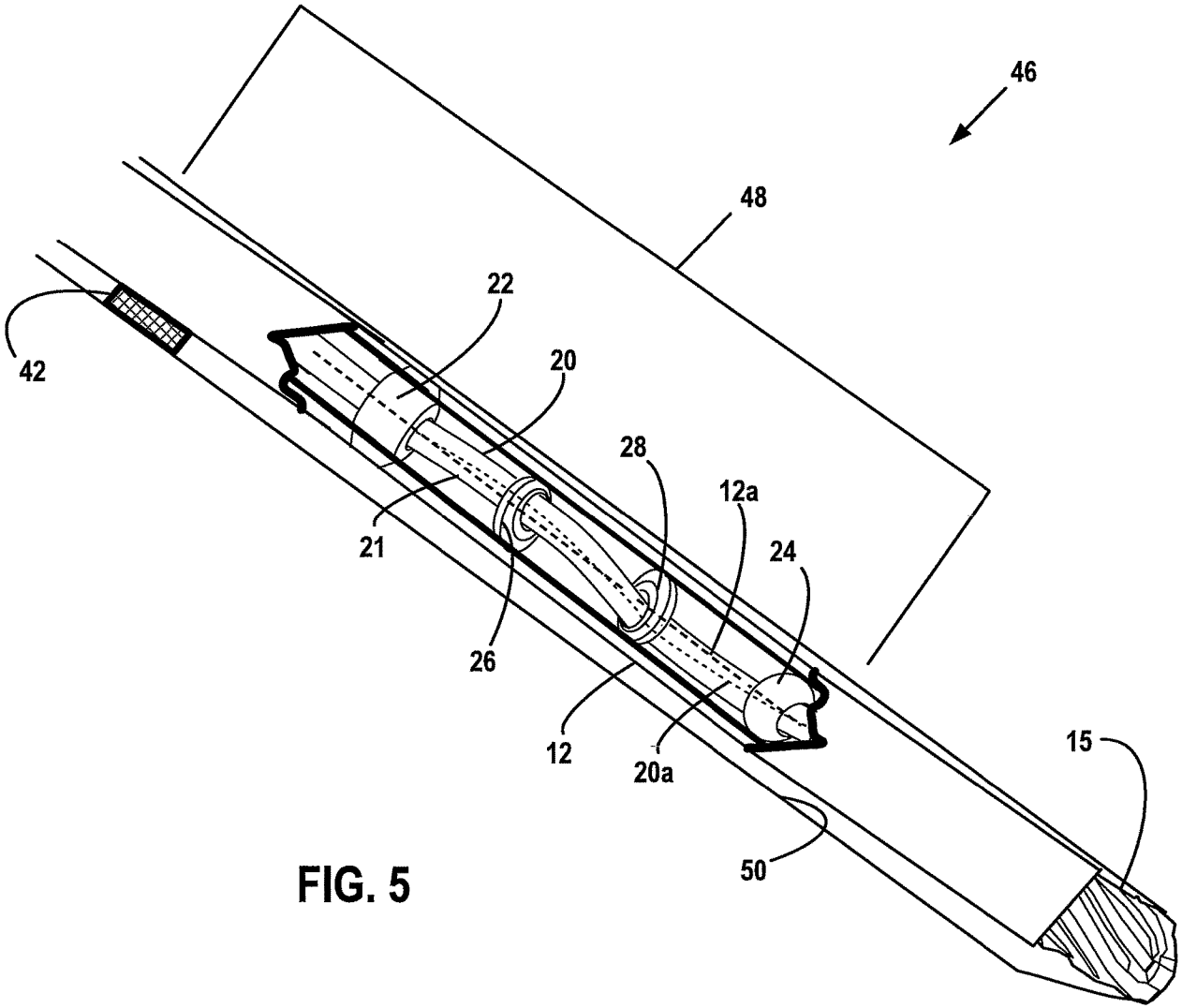
FIG. 5 is a diagrammatic view of a drilling system including a rotary steerable module that includes a pad, according to another exemplary embodiment.

In one exemplary embodiment, as illustrated in FIG. 5, a drilling system is generally referred to by the reference numeral 46 and includes the drill bit 15, the outer sleeve 12, and a rotary steerable module 48, a portion of which is disposed within the outer sleeve 12 and a portion of which is disposed outside of the outer sleeve 12. More particularly, the rotary steerable module 48 includes all of the components of the rotary steerable module 14, which components are given the same reference numerals and are disposed within the outer sleeve 12. The rotary steerable module 48 further includes the pad 42, which is connected to the outer sleeve 12 so that at least a portion of the pad 42 is positioned outside of the outer sleeve 12. In the rotary steerable module 48, the pad 42 is disposed along the outer sleeve 12 so that the pad 42 is positioned above the cantilever bearing 22, that is, so that the cantilever bearing 22 is positioned between the pad 42 and the upper cam 26.

In one exemplary embodiment, the drilling system 46 is a double bend push-the-bit rotary steerable system, which can be placed in either a reverse double bend configuration or an accordant double bend configuration. In several exemplary embodiments, the location of the pad 42, relative to the outer sleeve 12, may be varied. In several exemplary embodiments, the rotary steerable module 48 of the drilling system 38 may include one or more additional pads connected to the outer sleeve 12, each of which may be substantially identical to the pad 42.

In operation, in one exemplary embodiment, the drilling system 46 drills or penetrates into a subterranean ground formation for the purpose of recovering hydrocarbon fluids from the formation. As the drilling system 46 penetrates into the formation, a wellbore 50 is formed. During the drilling, the rotary steerable module 48 enables the drill string 21, and thus the flexible shaft 20 and the drill bit 15, to rotate continuously. The pad 42 interacts with the formation in which the wellbore 50 is being formed, thereby causing a side force to be generated, which side force deviates or pushes the drill bit 15 in a desired direction. In one exemplary embodiment, the pad 42 acts as a pivot for the deflection of the drill bit 15. The placement of the pad 42 and any additional pad(s), relative to the outer sleeve 12, enables the drill bit 15 to be steered in a controlled manner.

In several exemplary embodiments, during operation, the drilling system 46 operates as a double bend push-the-bit rotary steerable system. During operation, the rotary steerable module 48 of the system 46 may be placed in a reverse double bend configuration, as shown in FIG. 5. During operation, instead of a reverse double bend configuration, the rotary steerable module 48 of the system 46 may be placed in an accordant double bend configuration.

Figure 6:
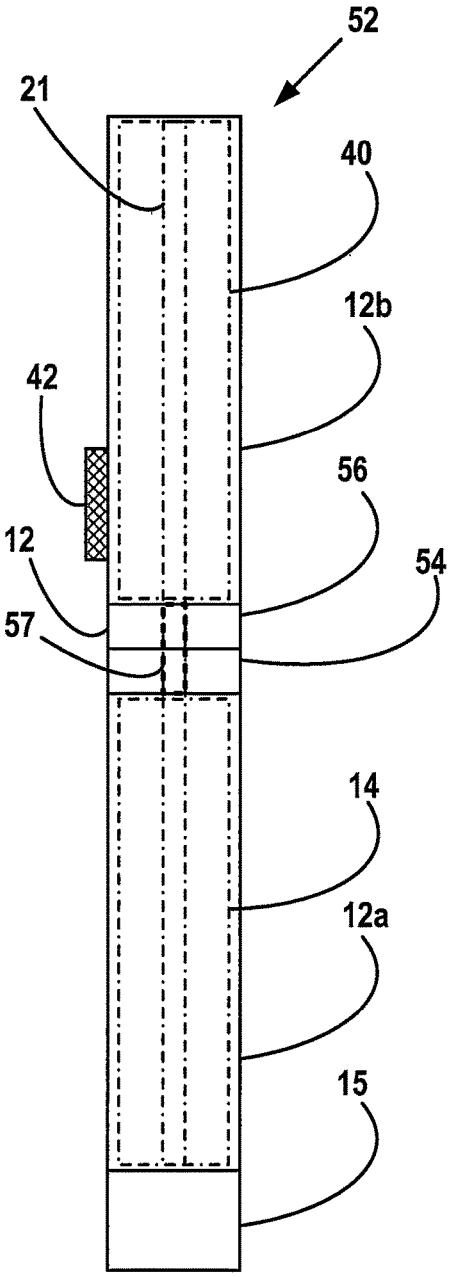
FIG. 6 is a diagrammatic view of a drilling system including two rotary steerable modules, according to an exemplary embodiment.

In one exemplary embodiment, as illustrated in FIG. 6, a drilling system is generally referred to by the reference numeral 52 and includes two rotary steerable modules as described herein. More specifically, the drilling system 52 includes a drill bit 15, an outer sleeve 12 having sections 12*a* and 12*b*, a rotary steerable module 14, and a rotary steerable module 40. The module 14 is disposed within the section 12*a* of the outer sleeve 12. The module 14 is also disposed between the drill bit 15 and the module 40, a portion of which is disposed within the section 12*b* of the outer sleeve 12. At least a portion of the pad 42 of the module 40 is disposed outside of, and carried by, the section 12*b* of the outer sleeve 12.

A connector 54 including an internal threaded connection (not shown) is connected to the upper end of the module 14. A connector 56 is connected to the lower end of the module 40. The connector 56 includes an external threaded connection (not shown), which is engaged with the internal threaded connection of the connector 54, thereby connecting the module 40 to the module 14. The sections 12*a* and 12*b*, the connector 54, and the connector 56 together form at least a portion of the outer sleeve 12. A connector 57 extends within at least the connectors 54 and 56, and connects the respective shafts 20 of the modules 14 and 40. The connector 57 and the respective shafts 20 of the modules 14 and 40 form at least a portion of the drill string 21, the lowermost end of which is connected to the drill bit 15.

In operation, in one exemplary embodiment, the drilling system 52 operates as a double bend hybrid rotary steerable system. More particularly, the module 40 of the drilling system operates as a double bend push-the-bit rotary steerable system, while the module 14 operates as a double bend point-the-bit rotary steerable system. The overall coherence of the drilling system 52 achieves a desired toolface vector.

During operation, in one exemplary embodiment, the module 14 is placed either in an accordant double bend configuration or in a reverse double bend configuration. Likewise, the module 40 is placed either in an accordant double bend configuration or in a reverse double bend configuration.

In several exemplary embodiments, another module substantially identical to one of the modules 14, 40 and 48 is connected to the upper end of the module 40. In several exemplary embodiments, one or more modules, each of which is substantially identical to one of the modules 14, 40 and 48, are connected to each other end-to-end, with the lowermost module connected to the module 40. In several exemplary embodiments, in the drilling system 52, either the module 14 or the module 40 is replaced with the module 48.

Figure 7:
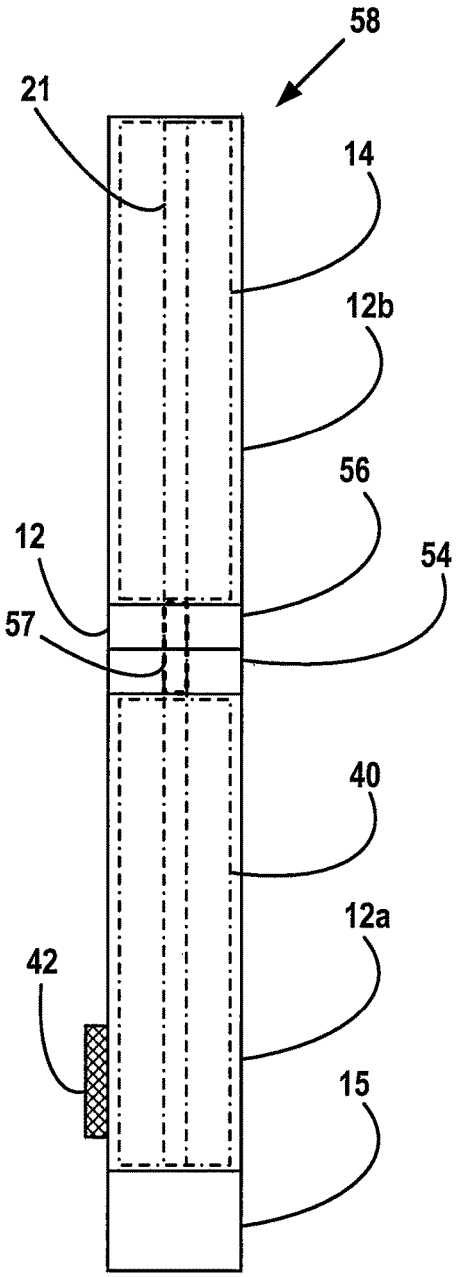
FIG. 7 is a diagrammatic view of a drilling system including two rotary steerable modules, according to another exemplary embodiment.

In one exemplary embodiment, as illustrated in FIG. 7, a drilling system is generally referred to by the reference numeral 58 and includes two rotary steerable modules as described herein. More specifically, the drilling system 58 includes a drill bit 15, an outer sleeve 12 having sections 12*a* and 12*b*, a rotary steerable module 40, and a rotary steerable module 14. The module 40 is disposed between the drill bit 15 and the module 14. A portion of the module 40 is disposed within the section 12*a* of the outer sleeve 12. At least a portion of the pad 42 of the module 40 is disposed outside of, and carried by, the section 12*a* of the outer sleeve 12. The module 14 is disposed within the section 12*b* of the outer sleeve 12.

The connector 54 is connected to the upper end of the module 40. The connector 56 is connected to the lower end of the module 14. The connector 56 is engaged with the connector 54, thereby connecting the module 14 to the module 40. The sections 12*a* and 12*b*, the connector 54, and the connector 56 together form at least a portion of the outer sleeve 12. The connector 57 extends within at least the connectors 54 and 56, and connects the respective shafts 20 of the modules 14 and 40. The connector 57 and the respective shafts 20 of the modules 14 and 40 together form at least a portion of the drill string 21, the lowermost end of which is connected to the drill bit 15.

In operation, in one exemplary embodiment, the drilling system 58 operates as a double bend hybrid rotary steerable system. More particularly, the module 40 of the drilling system operates as a double bend push-the-bit rotary steerable system, while the module 14 operates as a double bend point-the-bit rotary steerable system. The overall coherence of the drilling system 58 achieves a desired toolface vector.

During operation, in one exemplary embodiment, the module 14 is placed either in an accordant double bend configuration or in a reverse double bend configuration. Likewise, the module 40 is placed either in an accordant double bend configuration or in a reverse double bend configuration.

In several exemplary embodiments, another module substantially identical to one of the modules 14, 40 and 48 is connected to the upper end of the module 14. In several exemplary embodiments, one or more modules, each of which is substantially identical to one of the modules 14, 40 and 48, are connected to each other in tandem end-to-end, with the lowermost module connected to the module 14. As a result, wider angles may be achieved. In several exemplary embodiments, in the drilling system 58, either the module 14 or the module 40 is replaced with the module 48.

As shown in FIGS. 6 and 7, the modular aspect of each of the drilling systems 52 and 58 ensures the significant benefit of optimizing the selection of modules for the desired wellbore path, providing a topology that can be made coherent to achieve the desired toolface vector.

In several exemplary embodiments, with continuing reference to FIGS. 1-7, each of the drilling systems 10, 38, 46, 52 and 58 is not based on a single fixed bend angle, which would result in only one inclination, but instead permits multiple combinations of bends to achieve multiple inclinations. The multiple combinations may have desired ranges based on the respective inner diameters of the cams 26 and 28. Each of the drilling systems 10, 38, 46, 52 and 58 can be utilized in continuous drilling operations while still achieving enhanced steering control, thereby yielding accurate well placement, better hole quality and better hole cleaning.

Figure 8:
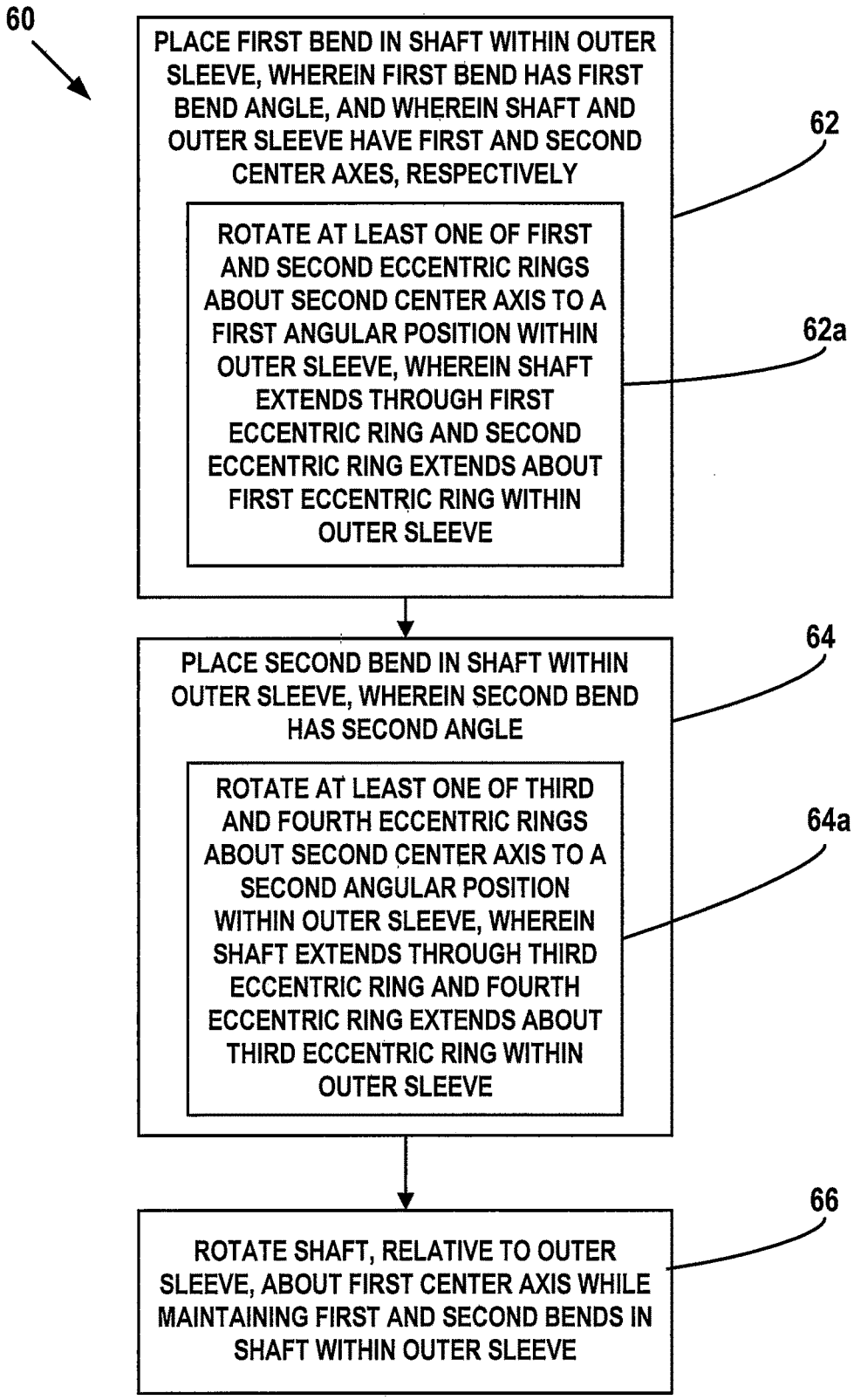
FIG. 8 is a flow chart illustration of a method of operating a drilling system, according to an exemplary embodiment.

In one exemplary embodiment, as illustrated in FIG. 8, a method of operating any one of the drilling systems 10, 38, 46, 52 and 58 is generally referred to by the reference numeral 60. The method 60 includes a step 62, at which a first bend is placed in a shaft within an outer sleeve, wherein the first bend has a first bend angle, and wherein the shaft and the outer sleeve have first and second center axes, respectively. Before, during or after the step 62, at step 64, a second bend is placed in the shaft within the outer sleeve, wherein the second bend has a second bend angle. At step 66, the shaft is rotated, relative to the outer sleeve, about the first center axis while maintaining the first and second bends in the shaft within the outer sleeve. In one exemplary embodiment, as shown in FIG. 8, the step 62 includes a step 62*a*, at which at least one of a first eccentric ring and a second eccentric ring is rotated about the second center axis to a first angular position within the outer sleeve, wherein the shaft extends through the first eccentric ring, and the second eccentric ring extends about the first eccentric ring within the outer sleeve. In one exemplary embodiment, as shown in FIG. 8, the step 64 includes a step 64*a*, at which at least one of a third eccentric ring and a fourth eccentric ring is rotated about the second center axis to a second angular position with the outer sleeve, wherein the shaft extends through the third eccentric ring, and the fourth eccentric ring extends about the third eccentric ring within the outer sleeve.

In several exemplary embodiments, the method 60 may be implemented in whole or in part by a computer. In several exemplary embodiments, the plurality of instructions stored on the computer readable medium 16*b*, the plurality of instructions stored on the computer readable medium 18*b*, a plurality of instructions stored on another computer readable medium, and/or any combination thereof, may be executed by a processor to cause the processor to carry out or implement in whole or in part the method 60, and/or to carry out in whole or in part the above-described operation of one or more of the drilling systems 10, 38, 46, 52 and 58. In several exemplary embodiments, such a processor may include the one or more processors 16*a*, the one or more processors 18*a*, one or more additional processors, and/or any combination thereof.

An example of a drilling system has been described that includes an outer sleeve; and a first rotary steerable module, comprising a first shaft extending within the outer sleeve; a first bearing disposed within the outer sleeve and through which the first shaft extends; a second bearing disposed within the outer sleeve and through which the first shaft extends, wherein the second bearing is spaced from the first bearing along the first shaft; a first cam disposed within the outer sleeve so that the first cam is positioned along the first shaft between the first and second bearings, the first cam comprising a first eccentric ring through which the first shaft extends; and a second eccentric ring extending about the first eccentric ring; wherein the extension of the first shaft through the first eccentric ring defines a first bend in the first shaft within the outer sleeve, the first bend having a first bend angle; and a second cam disposed within the outer sleeve so that the second cam is positioned along the first shaft between the first cam and the second bearing, the second cam comprising a third eccentric ring through which the first shaft extends; and a fourth eccentric ring extending about the third eccentric ring; wherein the extension of the first shaft through the second eccentric ring defines a second bend in the first shaft within the outer sleeve, the second bend having a second bend angle.

An example of a drilling method has been described that includes extending a shaft within an outer sleeve, wherein the shaft and the outer sleeve have first and second center axes, respectively; placing a first bend in the shaft within the outer sleeve, the first bend having a first bend angle; placing a second bend in the shaft within the outer sleeve, the second bend having a second bend angle; and rotating, relative to the outer sleeve, the shaft about the first center axis while maintaining the first and second bends in the shaft within the outer sleeve.

An example of a drilling control apparatus has been described that includes a computer readable medium; and a plurality of instructions stored on the computer readable medium and executable by a processor, the plurality of instructions comprising instructions that cause the processor to place a first bend in a shaft within an outer sleeve, wherein the first bend has a first bend angle, and wherein the shaft and the outer sleeve have first and second center axes, respectively; instructions that cause the processor to place a second bend in the shaft within the outer sleeve, wherein the second bend has a second bend angle; and instructions that cause the processor to rotate, relative to the outer sleeve, the shaft about the first center axis while maintaining the first and second bends in the shaft within the outer sleeve.

It is understood that variations may be made in the foregoing without departing from the scope of the disclosure.

Any spatial references such as, for example, "upper," "lower," "above," "below," "between," "bottom," "vertical," "horizontal," "angular," "upwards," "downwards," "side-to-side," "left-to-right," "left," "right," "right-to-left," "top-to-bottom," "bottom-to-top," "top," "bottom," "bottom-up," "top-down," etc., are for the purpose of illustration only and do not limit the specific orientation or location of the structure described above.

While the foregoing has been described in relation to a drill string and is particularly desirable for addressing dog-leg severity concerns, those skilled in the art with the benefit of this disclosure will appreciate that the drilling systems of this disclosure can be used in other drilling applications without limiting the foregoing disclosure.

What is claimed is:

1. A drilling system, comprising:

an outer sleeve; and a first rotary steerable module, comprising:

a first shaft extending within the outer sleeve, the outer sleeve having a center axis and a first section and a second section connected thereto;

a first bearing disposed within the outer sleeve and through which the first shaft extends;

a second bearing disposed within the outer sleeve and through which the first shaft extends, wherein the second bearing is spaced from the first bearing along the first shaft;

a first cam disposed within the outer sleeve so that the first cam is positioned along the first shaft between the first and second bearings, the first cam comprising:

a first eccentric ring through which the first shaft extends; and a second eccentric ring extending about the first eccentric ring;

wherein the extension of the first shaft through the first eccentric ring defines a first bend in the first shaft within the outer sleeve, the first bend having a first bend angle;

a second cam disposed within the outer sleeve so that the second cam is positioned along the first shaft between the first cam and the second bearing, the second cam comprising:

a third eccentric ring through which the first shaft extends; and a fourth eccentric ring extending about the third eccentric ring;

wherein the extension of the first shaft through the third eccentric ring defines a second bend in the first shaft within the outer sleeve, the second bend having a second bend angle;

a control unit operably coupled to each of the first and second cams comprising:

a processor;

a computer readable medium operably coupled to the processor; and a plurality of instructions stored on the computer readable medium and executable by the processor, wherein the plurality of instructions comprises:

instructions that cause the processor to rotate at least one of the first and second eccentric rings about the center axis to a first angular position, relative to the outer sleeve; and instructions that cause the processor to rotate at least one of the third and fourth eccentric rings about the center axis to a second angular position, relative to the outer sleeve;

wherein the first shaft, the first and second bearings, and the first and second cams of the first rotary steerable module are disposed within the first section of the outer sleeve; and a second rotary steerable module connected to the first rotary steerable module, the second rotary steerable module comprising:

a second shaft connected to the first shaft and extending within the second section of the outer sleeve;

a third bearing disposed within the second section of the outer sleeve and through which the second shaft extends;

a fourth bearing disposed within the second section of the outer sleeve and through which the second shaft extends, wherein the third bearing is spaced from the fourth bearing along the second shaft;

a third cam disposed within second section of the outer sleeve so that the third cam is positioned along the second shaft between the third and fourth bearings; and a fourth cam disposed within the second section of the outer sleeve so that the fourth cam is positioned along the first shaft between the third cam and the fourth bearing.

2. The drilling system of claim 1, wherein the first bend of the first shaft within the outer sleeve bends in a first angular direction; and wherein the second bend of the first shaft within the outer sleeve bends in a second angular direction that is the reverse of the first angular direction.

3. The drilling system of claim 1, wherein the first and second bends of the first shaft within the outer sleeve bend in the same angular direction.

4. The drilling system of claim 1, wherein the first shaft has a center axis and is rotatable about the center axis within, and relative to, the outer sleeve.

5. The drilling system of claim 1, wherein the outer sleeve and the first shaft have first and second center axes, respectively;

wherein the drilling system further comprises a drill bit connected to the first shaft, the drill bit having a range of movement defined at least in part by the first and second bend angles; and wherein the second center axis is angularly offset from the first center axis within the range of movement of the drill bit.

6. The drilling system of claim 1, wherein the first rotary steerable module comprises a pad connected to the outer sleeve, wherein at least a portion of the pad is positioned outside of the outer sleeve.

7. The drilling system of claim 1, wherein the second angular position is different than the first angular position; and wherein the first and second bend angles are dependent upon the first and second angular positions, respectively.

8. The drilling system of claim 1, wherein at least one of the first and second rotary steerable modules comprises a pad carried by one of the first and second sections of the outer sleeve, and wherein at least a portion of the pad is positioned outside of the outer sleeve.

9. A drilling method, comprising:

extending a first shaft within a first section of an outer sleeve, wherein the first shaft and the outer sleeve have first and second center axes, respectively;

placing a first bend in the first shaft within the outer sleeve, by extending the first shaft through a first eccentric ring positioned between a first and second bearing, the first bend having a first bend angle;

placing a second bend in the first shaft within the outer sleeve, by extending the first shaft through a second eccentric ring positioned between the first eccentric ring and the second bearing, the second bend having a second bend angle;

rotating, relative to the outer sleeve, the first shaft about the first center axis while maintaining the first and second bends in the first shaft within the outer sleeve;

extending a second shaft within a second section of the outer sleeve, wherein the second shaft and the second section of the outer sleeve have first and second center axes, respectively;

placing a third bend in the second shaft within the outer sleeve, by extending the second shaft through a third eccentric ring positioned between a third and fourth bearing, the third bend having a third bend angle;

placing a fourth bend in the second shaft within the outer sleeve, by extending the second shaft through a fourth eccentric ring positioned between the third eccentric ring and the fourth bearing, the fourth bend having a fourth bend angle; and rotating, relative to the outer sleeve, the second shaft about the first center axis while maintaining the third and fourth bends in the second shaft within the outer sleeve.

10. The drilling method of claim 9, wherein placing the first bend in the shaft within the outer sleeve further comprises:

extending the first shaft through the first eccentric ring about which a fifth eccentric ring extends within the outer sleeve; and rotating at least one of the first and fifth eccentric rings about the second center axis to a first angular position within the outer sleeve to thereby place the first bend in the first shaft within the outer sleeve.

11. The drilling method of claim 10, wherein placing the second bend in the first shaft within the outer sleeve comprises:

extending the first shaft through the second eccentric ring about which a sixth eccentric ring extends within the outer sleeve;

rotating at least one of the second and sixth eccentric rings about the second center axis to a second angular position within the outer sleeve to thereby place the second bend in the shaft within the outer sleeve.

12. The drilling method of claim 11, wherein the second angular position is different than the first angular position; and wherein the first and second bend angles are dependent upon the first and second angular positions, respectively.

13. The drilling method of claim 12, wherein the first bend within the outer sleeve bends in a first angular direction; and wherein the second bend within the outer sleeve bends in a second angular direction that is the reverse of the first angular direction.

14. The drilling method of claim 9, wherein the drilling method further comprises attaching a drill bit to the shaft, the drill bit having a range of movement defined at least in part by the first and second bend angles; and wherein the first center axis is permitted to be angularly offset from the second center axis within the range of movement of the drill bit.

* * * * *